US005465951A

United States Patent [19]

Burt et al.

[11] Patent Number: 5,465,951

[45] Date of Patent: Nov. 14, 1995

[54] FABRIC PIECE HANDLING SYSTEM

[75] Inventors: Donald E. Burt, Danvers; Jeffrey T. Boot, Sudbury; Matthew D. Bouche, Chelmsford; Carl Moeller, Duxbury, all of Mass.

[73] Assignee: Design Technology Corporation, Billerica, Mass.

[21] Appl. No.: 183,496

[22] Filed: Jan. 19, 1994

[51] Int. Cl.[6] ..... B65H 1/04

[52] U.S. Cl. ..... 271/167; 269/21; 271/105; 271/175; 414/903; 414/926

[58] Field of Search ..... 271/105, 175, 271/211; 414/903, 926; 269/21

[56] References Cited

U.S. PATENT DOCUMENTS

| | | | |
|---|---|---|---|
| 1,718,581 | 6/1929 | Rockstroh | 271/105 |
| 3,588,091 | 6/1971 | Stone et al. | 271/19 |
| 4,226,569 | 10/1980 | Gerard et al. | 269/21 X |
| 4,444,384 | 4/1984 | Keeton | 271/18.3 |
| 4,526,363 | 7/1985 | Fort | 271/268 |
| 4,697,837 | 10/1987 | Fort | 294/88 |
| 5,018,715 | 5/1991 | Reeves et al. | 271/19 |
| 5,144,873 | 9/1992 | Nasu | 269/21 X |

*Primary Examiner*—Michael S. Huppert
*Assistant Examiner*—Janice L. Krizek
*Attorney, Agent, or Firm*—Rhodes, Coats & Bennett

[57] ABSTRACT

A fabric piece handling apparatus for picking up and placing fabric pieces. The fabric piece handling apparatus includes a pickup assembly having a pair of opposed jaws, a "trapeze" unfolder assembly adjacent to the pickup assembly, and a vacuum assisted magazine for supplying a stack of fabric pieces to the pickup assembly.

20 Claims, 5 Drawing Sheets

FABRIC PIECE HANDLING SYSTEM

BACKGROUND OF THE INVENTION

1. Field of the Invention

The present invention relates generally to an apparatus for handling fabric pieces for apparel manufacture and, in particular, to a novel fabric pickup device for such an apparatus.

2. Description of the Prior Art

In order for a fabric piece handling system to be practical, it must have a high degree of reliability in separating a single piece of fabric from the top of a stack of fabric pieces without picking up two or more pieces. For example, it has been estimated that one malfunction in one thousand operation cycles is the degree of reliability necessary for a profitable manufacturing operation.

U.S. Pat. No. 4,444,384, issued to Keeton, discloses a cloth pickup device including first and second jaws pivotally mounted for movement from a clamping position to an open position. When the jaws are moved into contact with a piece of cloth, they are pivoted to clamp the cloth between them with needles extending from the first jaw piercing the cloth. An overcenter spring holds the jaws in both their first and second positions. When it is desired to release the cloth held by the jaws, a plunger is depressed, engaging the jaws and pivoting them to their open position.

U.S. Pat. No. 4,526,363, issued to Fort, discloses a gripper for textile machines which includes a gripping clamp and an apparatus for opening and closing the clamp. The clamp includes a fixed central member provided laterally and on either side with a resilient portion, two arms crossing each other for constituting a pair of gripping jaws, each arm being provided with a key preferably in the outer extension of the resilient portion. The opening and closing apparatus includes a pair of vertically movable fingers, by reason of one per arm, which are adapted in their lower position to depress the keys in order to cause the distortion of the resilient portions and thus modify the degree of crossing of the jaw forming portions. The height of the vertically movable fingers appears to be adjustable to control the degree of opening of the jaws.

A somewhat similar device is shown in U.S. Pat. No. 4,697,837, also issued to Fort, for a gripper. The gripper includes tongs formed by two oscillating jaws. The jaws are solid in rotation with two shafts rotating in bearings carried by a frame solid with the rod of a jack. The rotation of the shaft is caused by the angular movement of a maneuvering part connecting each shaft to a stationary part.

In addition to the above "pinch-type" devices, various other pickup devices employing one or more gripping clutches have been proposed. U.S. Pat. Nos. 5,018,715 and 3,588,091 and the Tex-Matic product brochure are illustrative of such approaches.

U.S. Pat. No. 5,018,715, issued to Reeves et al., discloses a fabric pickup device useful for a fabric handling system. The fabric pickup device includes a fluid operated cylinder and piston having four individual fabric clutches attached to the cylinder and aligned with and substantially equality spaced apart from the axis of the piston. Each clutch has a head portion having a plurality of resilient pickup fingers spaced apart from one another. A substantially flat actuator plate is attached to the free end of the piston and is oriented perpendicular to the axis of the piston. The actuator plate has a series of apertures for receiving the individual pickup fingers. The openings in the actuator plate are sized such that when the plate is retracted by the action of the fluid cylinder, the resilient fingers of each pickup finger separate and, when the plate is extended, the fingers are brought together to grip the top surface of a fabric piece. Because the pickup fingers are actuated by the movement and contact with the actuator plate and are themselves fixedly mounted to the actuator plate, the vertical position of the pickup fingers remains constant even during actuation, thereby reducing the degree of control necessary for reliable ply separation of small fabric pieces.

U.S. Pat. No. 3,558,091 issued to Stone et al., discloses an apparatus and method for picking up individual pieces of cloth from a stack, carrying the individual pieces of cloth away from the point of picking them up, and depositing them individually on a support, such as a conveyor. The pickup head, as taught by Stone, has a sleeve having one end secured to the piston of an air cylinder and the lower end formed to provide a plurality of equally spaced fingers having cloth-gripping or pinching bottom terminals. The sleeve is surrounded by a head or housing having a bore for receiving the sleeve which includes a lower adjustable portion which has a bore which engages the finger terminals when the air cylinder is actuated. Consequently, when the air cylinder is displaced downwardly, the surfaces of the gripping fingers contact the surface of the lower housing which results in closing the fingers so as to pinch a layer of cloth preparatory to lifting the cloth from the stack.

The Tex-Matic product brochure shows a fabric pickup having six individual gripping fingers equally spaced apart from one another. The fabric pickup device as disclosed by the Tex-Matic product brochure is air operated by a single cylinder which actuates the plurality of pickup fingers simultaneously.

Certain disadvantages become apparent with such designs. First, many of the prior art devices require that the surface of the cloth be penetrated in part by a wire or needle, for example in the construction of the pickup devices as taught by Keeton and Fort '363, in order to increase the reliability of the cloth pickup. Such penetration can result in the introduction of undesirable surface defects, particularly in tightly woven or shear fabrics.

Second, prior art devices have not provided a means for aiding the release of the fabric piece from the pickup device to prevent "sticking" of the fabric piece in the pickup head.

Finally, many prior art pickup devices are designed in such a way that a compound movement in both the vertical as well as the horizontal planes must be made in order to contact and pickup the fabric piece. This requires that the position of the device be carefully controlled in both the x,y directions and the z direction. For example, in the construction of the pickup device as taught by Stone, the pickup fingers themselves actually move downwardly and, consequently, the distance between a fabric piece and the pickup head varies when the device is actuated. As a result, such a device cannot be readily adapted to a simple x,y coordinate control system.

It has thus become desirable to develop a fabric pickup device for a fabric handling apparatus that will reliably pickup and release pieces of fabric from a supported stack of fabric one at a time without picking up two or more pieces. It has also become desirable to develop a pickup device which will not mar the surface of the fabric.

SUMMARY OF THE INVENTION

The present invention is directed to a fabric piece handling apparatus for picking up and placing fabric pieces. The fabric piece handling apparatus includes a pickup assembly having a pair of opposed jaws, a "trapeze" unfolder assembly adjacent to the pickup assembly, and a vacuum assisted magazine for supplying a stack of fabric pieces to the pickup assembly.

In the preferred embodiment, the pickup assembly includes: (i) a frame; (ii) a first opposed jaw rigidly attached at one end of the frame; (iii) a second opposed jaw movably attached at one end to the frame; and (iv) actuating means attached between the frame and the second opposed jaw, the actuating means adapted for moving the second opposed jaw between a first position wherein the pair of opposed jaws are in an unobstructed open position to allow a piece of cloth to bulge into a position between the pair of opposed jaws and a second position wherein the pair of opposed jaws are in an operative clamping position with respect to each other to clamp a piece of cloth therebetween.

Also in the preferred embodiment, the unfolder assembly includes: (i) a pair of pivotally mounted arms attached at one end to opposite sides of the pickup assembly; (ii) a horizontal bar extending between the other of the ends of the arms; and (iii) an actuator attached to at least one of the arms for moving the arms and horizontal bar in an arc beneath the pickup assembly to turn over a fabric piece held by the pickup assembly.

The vacuum assisted magazine includes inner walls, outer walls, and a top defining a plenum; a perforated aperture located in the inner wall adjacent to the upper surface of the stack of fabric pieces; and a source of vacuum connected to the plenum for providing a stream of air through the perforated aperture adjacent to the upper surface of the stack of fabric pieces, thereby causing the fabric pieces beneath the top ply of fabric and adjacent to the perforated aperture to remain stationary and allowing the top ply of fabric to be removed by the pickup assembly. The magazine includes a platen for supporting the stack of fabric pieces and a lead screw attached to the bottom surface of the platen for maintaining the stack of fabric pieces adjacent to the perforated aperture.

The apparatus further includes ejector means attached to the actuating means, wherein the ejector means and actuating means cooperate together to disengage a fabric piece from the pair of jaws when the pair of opposed jaws are in the first position wherein the pair of opposed jaws are in an unobstructed open position. In the preferred embodiment the ejector means is a tube connected to a source of compressed air for providing a pulse of compressed air to disengage a fabric piece when the pair of opposed jaws are in an unobstructed open position.

Accordingly, one aspect of the present invention is to provide a fabric piece handling apparatus. The apparatus includes: (a) a pickup assembly; (b) a magazine for supplying a stack of fabric pieces to the pickup assembly, the magazine including inner walls, outer walls, and a top defining a plenum and a perforated aperture located in the inner wall adjacent to the upper surface of the stack of fabric pieces; and (c) a source of vacuum connected to the plenum for providing a stream of air through the perforated aperture adjacent to the upper surface of the stack of fabric pieces, thereby causing the fabric pieces beneath the top ply of fabric and adjacent to the perforated aperture to remain stationary and allowing the top ply of fabric to be removed by the pickup assembly.

Another aspect of the present invention is to provide a pickup device for use with a fabric piece handling apparatus. The device includes: (a) a frame; (b) a first opposed jaw rigidly attached at one end of the frame; (c) a second opposed jaw movably attached at one end to the frame; and (d) actuating means attached between the frame and the second opposed jaw, the actuating means adapted for moving the second opposed jaw between a first position wherein the pair of opposed jaws are in an unobstructed open position to allow a piece of cloth to bulge into a position between the pair of opposed jaws and a second position wherein the pair of opposed jaws are in an operative clamping position with respect to each other to clamp a piece of cloth therebetween.

Still another aspect of the present invention is to provide a fabric piece handling apparatus. The apparatus includes: (a) a pickup assembly, wherein the pickup assembly includes: (i) a frame; (ii) a first opposed jaw rigidly attached at one end of the frame; (iii) a second opposed jaw movably attached at one end to the frame; and (iv) actuating means attached between the frame and the second opposed jaw, the actuating means adapted for moving the second opposed jaw between a first position wherein the pair of opposed jaws are in an unobstructed open position to allow a piece of cloth to bulge into a position between the pair of opposed jaws and a second position wherein the pair of opposed jaws are in an operative clamping position with respect to each other to clamp a piece of cloth therebetween; (b) an unfolder assembly adjacent to the pickup assembly, wherein the unfolder assembly includes: (i) a pair of pivotally mounted arms attached at one end to opposite sides of the pickup assembly; (ii) a horizontal bar extending between the other of the ends of the arms; and (iii) an actuator attached to at least one of the arms for moving the arms and horizontal bar in an arc beneath the pickup assembly to turn over a fabric piece held by the pickup assembly; (c) a magazine for supplying a stack of fabric pieces to the pickup assembly, the magazine including inner walls, outer walls, and a top defining a plenum and a perforated aperture located in the inner wall adjacent to the upper surface of the stack of fabric pieces; and (d) a source of vacuum connected to the plenum for providing a stream of air through the perforated aperture adjacent to the upper surface of the stack of fabric pieces, thereby causing the fabric pieces beneath the top ply of fabric and adjacent to the perforated aperture to remain stationary and allowing the top ply of fabric to be removed by the pickup assembly.

These and other aspects of the present invention will become apparent to those skilled in the art after a reading of the following description of the preferred embodiment when considered with the drawings.

DESCRIPTION OF THE PREFERRED EMBODIMENTS

Figure 2:
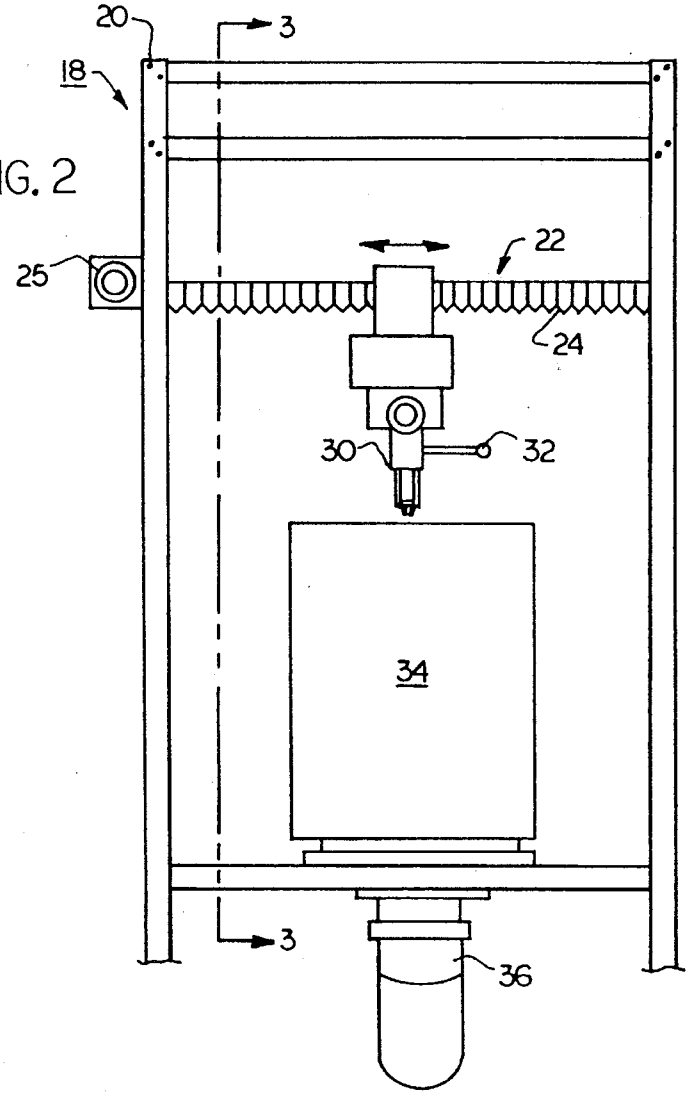
FIG. 2 is a rear elevational view of a fabric piece handling apparatus, constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
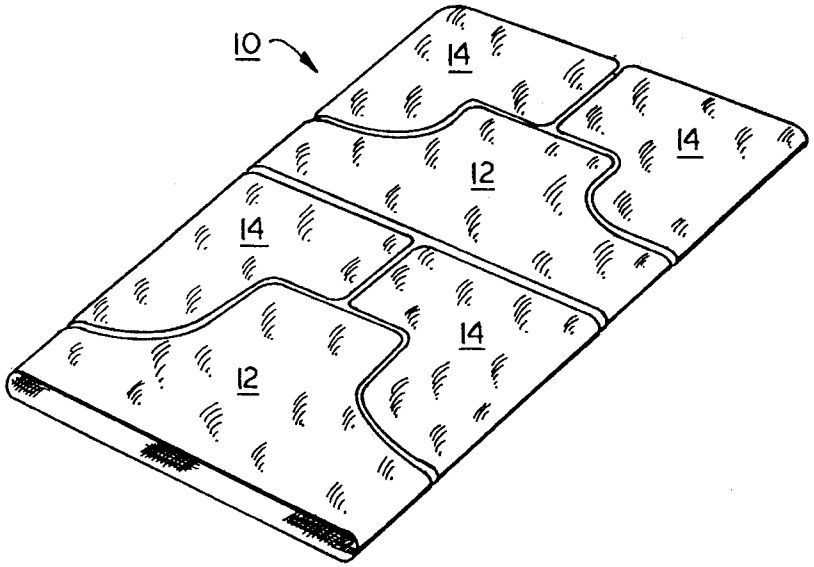
FIG. 1 is a fragmentary perspective view of a length of tubular knit fabric illustrating the cutting pattern for forming a plurality of back panels for a men's brief.
Figure 4A:
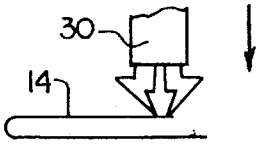
FIGS. 4A–4E are schematic views illustrating the movement of a fabric piece by the present invention when handling a folded fabric piece.
Figure 4B:
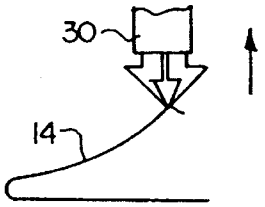
Figure 4C:
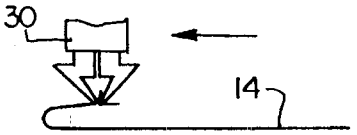
Figure 4D:
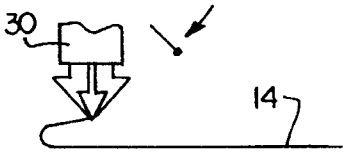
Figure 4E:
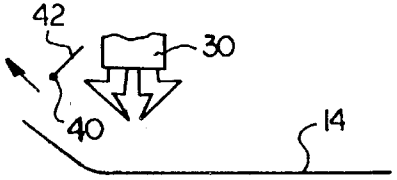

Referring now to the drawings in general and to FIG. 1 in particular, it will be understood that the illustrations are for the purpose of describing a preferred embodiment of the invention and are not intended to limit the invention thereto. As best seen in FIG. 1, there is shown a roll of tubular knit fabric, generally designated 10. It is well known in the textile industry to first manufacture such a roll of tubular knit fabric and then cut it into individual fabric pieces. Panels which are cut across a full section, such as fabric pieces 12, are known as "cut on flat". Fabric pieces which wrap around a portion of the tubular knit fabric, such as fabric pieces 14, are known as "cut on fold". Such a cutting arrangement allows a high utilization of the tubular knit fabric and minimizes the amount of resulting scrap area. After cutting, it is conventional practice to separate the cut fabric pieces 12, 14 into bundles which are hand-sewn by sewing machine operators at individual work stations. This process has resisted automation because of the lack of any means for reliably moving the fabric pieces from one work station to another.

As best seen in FIG. 2, there is shown a rear elevational view illustrating an automatic fabric handling apparatus, generally designated 18, constructed according to the present invention. In the preferred embodiment, fabric handling apparatus 18 includes a support frame 20 for supporting a fabric pick-up assembly 22.

Fabric pick-up assembly 22 includes a linear drive means 24 which includes a motor 25. A support 26 is attached to the linear drive means 24 for mounting a plurality of pick-up devices 30. Also in the preferred embodiment, the pick-up assembly 22 includes a "trapeze" unfolder assembly 32. Located adjacent to the pick-up assembly 22 is a fabric piece magazine 34. Fabric piece magazine 34 is connected to a vacuum source 36 as will best be understood later.

Figure 3:
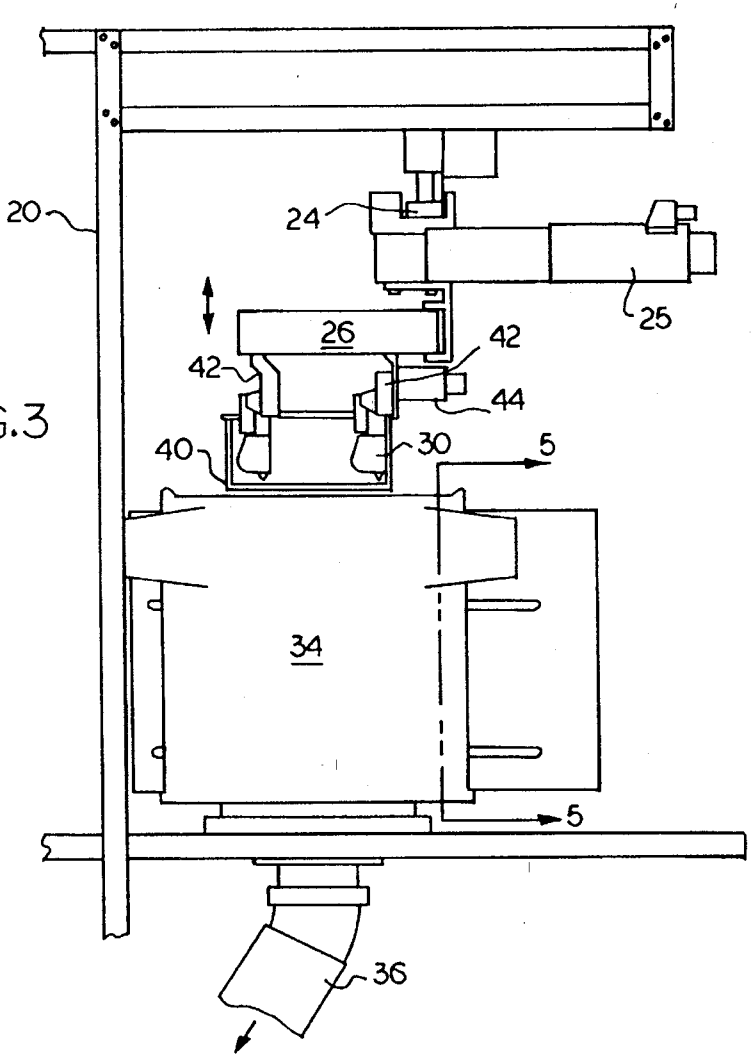
FIG. 3 is a side elevational view of the fabric piece handling apparatus shown in FIG. 2, taken along line 3—3.

Turning to FIG. 3, there is shown a side elevational view illustrating the fabric handling apparatus 18 shown in FIG. 2, taken along line 3—3. As can be seen, the trapeze unfolder assembly 32 includes a horizontal bar 40 attached to a pair of pivotally-mounted arms 42 which, in turn, are driven in an arc by actuator 44. The sequence of operations and coordination between the pick-up device 30 and the trapeze unfolder assembly 32 can best be seen by referring to FIGS. 4A–4E.

FIGS. 4A–4E are schematic views illustrating the movement of a folded fabric piece by the present invention. In operation, the pick-up device 30 is positioned adjacent to one edge of the folded fabric piece 14 and brought in contact with the surface of the fabric piece (4A). The pick-up device 30 is then actuated to grasp the surface of the folded fabric piece 14 and to lift it upwardly to separate it from the adjacent folded fabric piece (4B). The pick-up device is then moved in a linear fashion to unfold the fabric piece. However, as can be seen, a portion of the fabric piece is still folded (4C). At this point, the trapeze unfolder assembly 32 is actuated and trapeze bar 40 is moved through an arc which passes beneath the pick-up device 30 (4D). As trapeze bar 40 passes beneath pick-up device 30, the pick-up jaws are opened to release the fabric piece 14. The trapeze bar 40 then continues its arc thereby completing the unfolding operation (4E).

Figure 5:
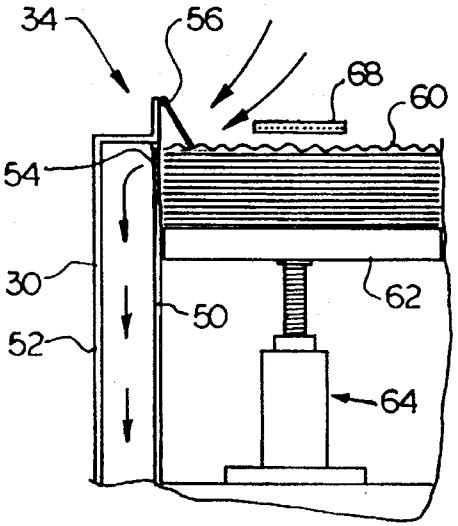
FIG. 5 is an enlarged partial cross-sectional view of the vacuum magazine shown in FIG. 3, taken along line 5–5.

Alternating layers of knitted fabric have a tendency to stick together. Accordingly, in the preferred embodiment, fabric piece magazine 34 provides an aid to separate the edges of adjacent fabric pieces. As best seen in FIG. 5, there is shown an enlarged, partial cross-sectional view of the fabric piece magazine 34 shown in FIG. 3, taken along line 5—5. In the preferred embodiment, fabric piece magazine 34 includes concentrically positioned inner and outer walls 50, 52 and a top which define a vacuum plenum. A slot 54 is located on inner wall 50. A flexible flap 56 is attached along the upper edge of slot 54. A stack of fabric pieces 60 rests on a platen 62 which is raised by a lead screw 64 to maintain the top of the stack of fabric pieces 60 adjacent to slot 54. In operation, the movement of air due to the vacuum source connected to the plenum causes the fabric pieces 60 beneath the top ply of fabric and adjacent to the perforated aperture 54 to remain stationary and to allow the top ply of fabric to be removed by the pickup assembly.

In the preferred embodiment, the magazine 34 further includes a source of compressed air 68 adjacent to the flexible flap 56 for providing a stream of air across the upper surface of the stack of fabric pieces 60, thereby causing the edges of the fabric pieces to flutter and separate from one another. The "fluttering" of the edges of the stack of fabric pieces tends to separate adjacent fabric pieces and improve the release of one fabric piece from another. The vacuum magazine significantly improves the reliability that only a single sheet of knitted fabric will be removed at a time.

Figure 6:
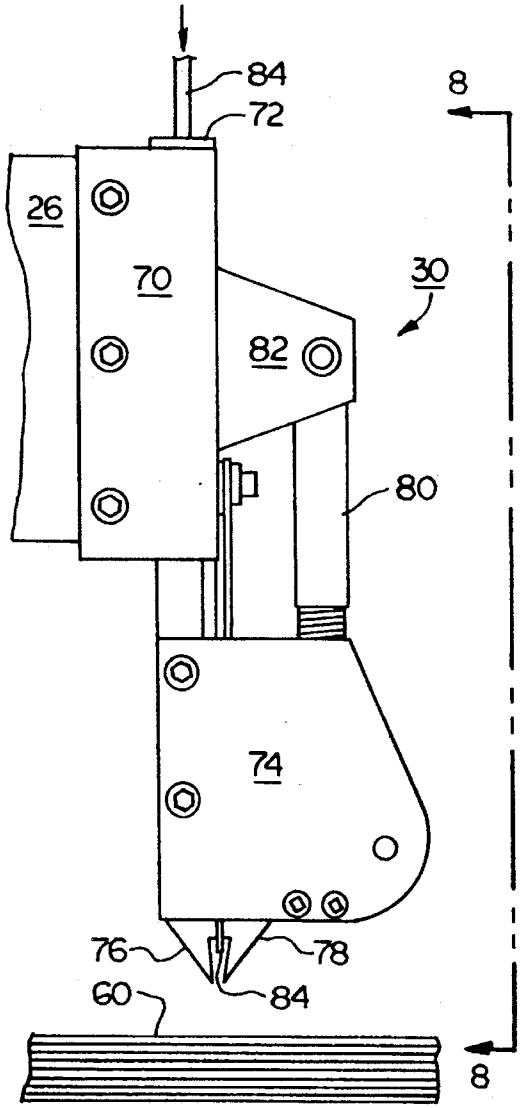
FIG. 6 is a front elevational view of a single fabric pickup device, constructed according to the present invention.

As best seen in FIG. 6, there is shown a front elevational view of a single fabric pick-up device 30, constructed according to the present invention. In the preferred embodiment, fabric pick-up device 30 includes a mounting base 70 which is attached to support 26. A frame 72 is slidably mounted to the base 70 thereby allowing the pick-up device to adjust for variations in the height of stacks of fabric pieces 60. A gripper head 74 is attached to one end of the frame 72.

Gripper head 74 includes a stationary jaw 76 and a moveable jaw 78. The jaws 76, 78 are actuated by a pneumatic cylinder 80 having one end attached to bracket 82 and the other end attached to gripper head 74. In the preferred embodiment, an air ejector tube passes through frame 72 and has one end connected to a source of compressed air and the other end adjacent to jaws 76, 78.

Figure 7:
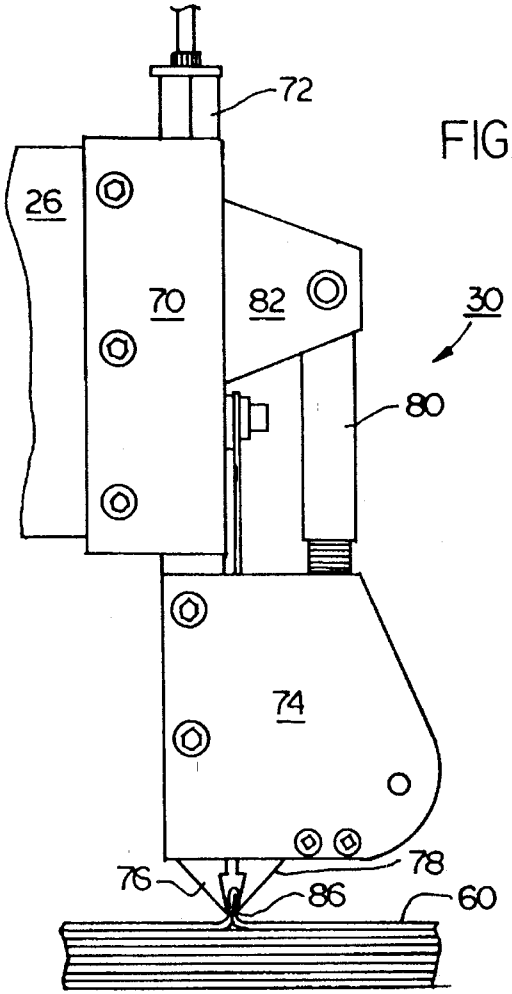
FIG. 7 is an identical front elevational view of the fabric pickup device shown in FIG. 6 but in its closed position.

As best seen in FIG. 7, when the pick-up device 30 is actuated, jaw 78 is moved toward jaw 76 together to hold a fabric nib 86 of the upper sheet of the stack of fabric pieces 60.

Figure 8:
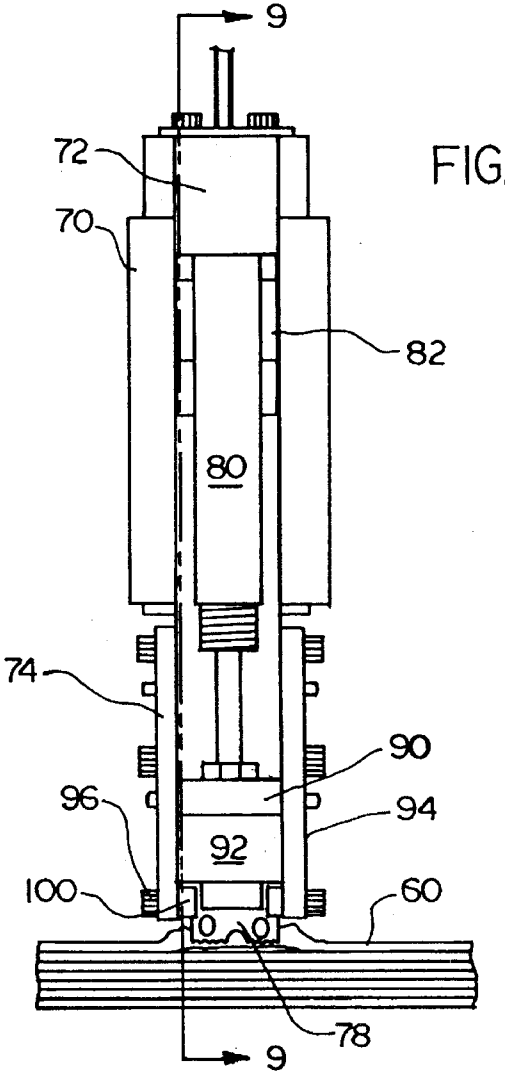
FIG. 8 is a side elevational view of the fabric pickup device shown in FIG. 6, taken along line 8–8.

Turning to FIG. 8, there is shown a side elevational view of the pick-up device 30 shown in FIG. 6, taken along line 8—8. As can be seen, a "wedge" block 90 is connected to pneumatic cylinder 80. A first guide roller 92 is movably mounted between a pair of generally parallel support plates 94, 96. A pair of jaw stops 100, 102 are attached to the inner walls of support plates 94, 96 to limit the opening movement of jaw 78 to permit a fixed amount of fabric to fit between the jaws.

Figure 9:
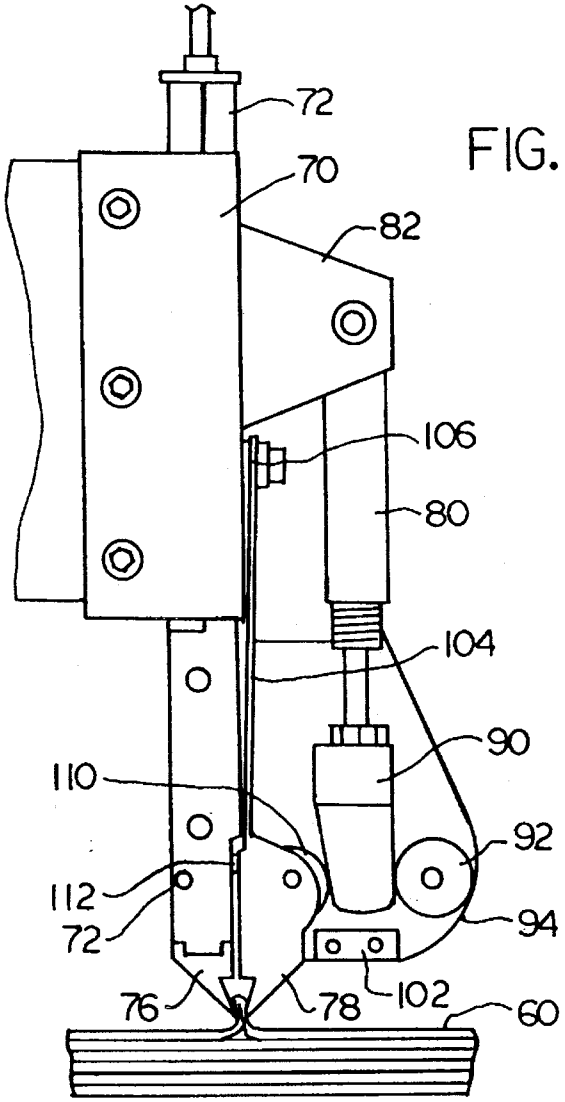
FIG. 9 is a cross sectional view of the fabric pickup device shown in FIG. 8, taken along line 9–9.

Referring now to FIG. 9, there is shown a cross-sectional view of the pick-up device 30 shown in FIG. 8 taken along line 9—9. As can be seen, moveable jaw 78 is attached to one end of a cantilever arm 104. The other end of arm 104 is attached to frame 72 by fastener 106. The end of the arm 104 adjacent to jaw 78 includes a second guide roller 110. A spring and stop 112 is located between the end of cantilever arm 104 adjacent to jaw 78 and frame 72.

In operation, when pneumatic cylinder 80 is actuated, wedge block 90 moves between first and second guide rollers 92, 110. As block 90 passes between the rollers, cantilever arm 104 is moved toward frame 72 thereby compressing spring 112 and causing jaw 78 to approach jaw 76. In the preferred embodiment, jaw stops 100, 102 attached to the inner wall of support plates 94, 96 limit the opening movement of cantilever arm 104 when wedge block 90 is retracted. This arrangement provides for exceptional control of the positioning and movement of jaws 76, 78.

Figure 10:
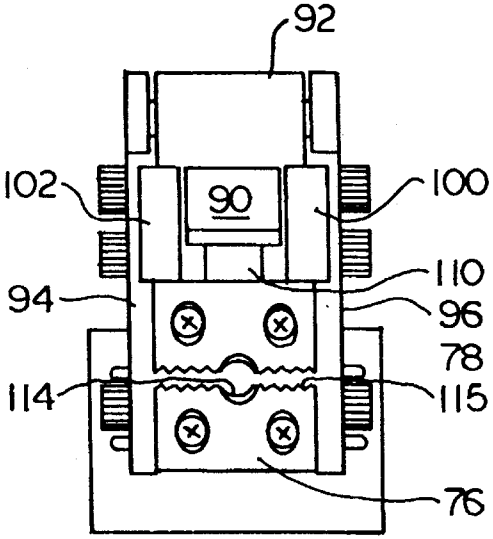
FIG. 10 is an enlarged bottom view of the fabric pickup device shown in FIG. 6 illustrating the geometry of the fabric engaging teeth.

Finally, turning to FIG. 10, there is shown an enlarged bottom view of the pick-up device shown in FIG. 6. As can be seen, the leading edges of jaws 76, 78, each include a semi-circular groove 114 which forms an opening through which air ejector tube 84 can provide a pulse of compressed air to ensure release of fabric nib 86 when the jaws are opened. Also in the preferred embodiment, the leading edges of jaws 76, 78 include a plurality of ridged teeth 115 which aid the jaws in grasping the surface of the fabric piece but do not penetrate the fabric piece.

Certain modifications and improvements will occur to those skilled in the art upon reading of the foregoing description. For example, while a lead screw is the preferred embodiment to raise the platen, other linear actuators may be adapted to perform the same function. It should be understood that all such modifications and improvements have been deleted herein for the sake of conciseness and readability but are properly within the scope of the following claims.

We claim:

1. A fabric piece handling apparatus, said apparatus comprising:

(a) a pickup assembly;

(b) a magazine for supplying a stack of fabric pieces having a plurality of plys to said pickup assembly, said magazine including inner walls, outer walls, and a top, said magazine defining a plenum having a perforated aperture located in said inner wall adjacent to the upper surface of the stack of fabric pieces located adjacent to said top, wherein said magazine includes a flexible flap having one edge attached to said inner wall adjacent to said perforated aperture and the opposite edge extending to the surface of said stack of fabric pieces located adjacent to said top; and (c) a source of vacuum connected to said plenum for providing a stream of air through said perforated aperture adjacent to the upper surface of the stack of fabric pieces, thereby causing said fabric pieces beneath the top ply of fabric and adjacent to said perforated aperture to remain stationary and allowing the top ply of fabric to be removed by said pickup assembly.

2. The apparatus according to claim 1, wherein said flexible flap is formed from a sheet of elastomeric material.

3. The apparatus according to claim 1, further including a source of compressed air adjacent to said flexible flap for providing a stream of air across the upper surface of said stack of fabric pieces, thereby causing the edges of said fabric pieces to flutter and separate from one another.

4. The apparatus according to claim 1, wherein said magazine includes a platen for supporting said stack of fabric pieces.

5. The apparatus according to claim 4, wherein said platen for supporting said stack of fabric pieces includes a connection to said source of vacuum and a plenum having a perforated aperture adjacent to the lower surface of said stack located on said platen for causing said fabric pieces to remain stationary.

6. The apparatus according to claim 4, wherein said magazine includes a lead screw attached to the bottom surface of said platen for maintaining said stack of fabric pieces adjacent to said perforated aperture.

7. The apparatus according to claim 1, further including an unfolder assembly adjacent to said pickup assembly, wherein said unfolder assembly includes: (i) a pair of pivotally mounted arms attached at one end to opposite sides of said pickup assembly; (ii) a horizontal bar extending between the other of the ends of said arms; and (iii) an actuator attached to at least one of said arms for moving said arms and horizontal bar in an arc beneath said pickup assembly to turn over a fabric piece held by said pickup assembly.

8. A fabric piece handling apparatus, said apparatus comprising:

(a) a pickup assembly;

(b) a magazine for supplying a stack of fabric pieces having a plurality of plys to said pickup assembly, said magazine including inner walls, outer walls, and a top, said magazine defining a plenum having a perforated aperture located in said inner wall adjacent to the upper surface of the stack of fabric pieces located in the magazine adjacent to said top, wherein said magazine includes a platen for supporting said stack of fabric pieces and wherein said magazine includes a lead screw attached to the bottom surface of said platen for maintaining said stack of fabric pieces adjacent to said perforated aperture; and (c) a source of vacuum connected to said plenum for providing a stream of air through said perforated aperture adjacent to the upper surface of the stack of fabric pieces, thereby causing said fabric pieces beneath the top ply of fabric and adjacent to said perforated aperture to remain stationary and allowing the top ply of fabric to be removed by said pickup assembly.

9. The apparatus according to claim 8, wherein said magazine includes a flexible flap having one edge attached to said inner wall adjacent to said perforated aperture and the opposite edge extending to the surface of said stack of fabric pieces located in the magazine adjacent to said top.

10. The apparatus according to claim 9, wherein said flexible flap is formed from a sheet of elastomeric material.

11. The apparatus according to claim 9, further including a source of compressed air adjacent to said flexible flap for providing a stream of air across the upper surface of said stack of fabric pieces, thereby causing the edges of said fabric pieces to flutter and separate from one another.

12. The apparatus according to claim 8, wherein said platen for supporting said stack of fabric pieces includes a connection to said source of vacuum and a plenum having a perforated aperture adjacent to the lower surface of said stack located on said platen for causing said fabric pieces to remain stationary.

13. The apparatus according to claim 8, further including an unfolder assembly adjacent to said pickup assembly, wherein said unfolder assembly includes: (i) a pair of pivotally mounted arms attached at one end to opposite sides of said pickup assembly; (ii) a horizontal bar extending between the other of the ends of said arms; and (iii) an actuator attached to at least one of said arms for moving said arms and horizontal bar in an arc beneath said pickup assembly to turn over a fabric piece held by said pickup assembly.

14. A fabric piece handling apparatus, said apparatus comprising:

(a) a pickup assembly;

(b) a magazine for supplying a stack of fabric pieces having a plurality of plys to said pickup assembly, said magazine including inner walls, outer walls, and a top, said magazine defining a plenum having a perforated aperture located in said inner wall adjacent to the upper surface of the stack of fabric pieces located in the magazine adjacent to said top;

(c) a source of vacuum connected to said plenum for providing a stream of air through said perforated aperture adjacent to the upper surface of the stack of fabric pieces, thereby causing said fabric pieces beneath the top ply of fabric and adjacent to said perforated aperture to remain stationary and allowing the top ply of fabric to be removed by said pickup assembly; and (d) an unfolder assembly adjacent to said pickup assembly, wherein said unfolder assembly includes: (i) a pair of pivotally mounted arms attached at one end to opposite sides of said pickup assembly; (ii) a horizontal bar extending between the other of the ends of said arms; and (iii) an actuator attached to at least one of said arms for moving said arms and horizontal bar in an arc beneath said pickup assembly to turn over a fabric piece held by said pickup assembly.

15. The apparatus according to claim 14, wherein said magazine includes a flexible flap having one edge attached to said inner wall adjacent to said perforated aperture and the opposite edge extending to the surface of said stack of fabric pieces located in the magazine adjacent to said top.

16. The apparatus according to claim 15, wherein said flexible flap is formed from a sheet of elastomeric material.

17. The apparatus according to claim 15, further including a source of compressed air adjacent to said flexible flap for providing a stream of air across the upper surface of said stack of fabric pieces, thereby causing the edges of said fabric pieces to flutter and separate from one another.

18. The apparatus according to claim 14, wherein said magazine includes a platen for supporting said stack of fabric pieces.

19. The apparatus according to claim 18, wherein said platen for supporting said stack of fabric pieces includes a connection to said source of vacuum and a plenum having a perforated aperture adjacent to the lower surface of said stack located on said platen for causing said fabric pieces to remain stationary.

20. The apparatus according to claim 18, wherein said magazine includes a lead screw attached to the bottom surface of said platen for maintaining said stack of fabric pieces adjacent to said perforated aperture.

* * * * *